US011631512B2

(12) United States Patent
Inomata et al.

(10) Patent No.: US 11,631,512 B2
(45) Date of Patent: Apr. 18, 2023

(54) VARIABLE RESISTOR

(71) Applicant: Alps Alpine Co., Ltd., Tokyo (JP)

(72) Inventors: Satoshi Inomata, Miyagi-ken (JP); Yasushi Watanabe, Miyagi-ken (JP); Junichi Hosogoe, Miyagi-ken (JP); Hisashi Komatsu, Miyagi-ken (JP); Hironobu Ishii, Miyagi-ken (JP)

(73) Assignee: Alps Alpine Co., Ltd., Tokyo (JP)

( * ) Notice: Subject to any disclaimer, the term of this patent is extended or adjusted under 35 U.S.C. 154(b) by 87 days.

(21) Appl. No.: 17/394,037

(22) Filed: Aug. 4, 2021

(65) Prior Publication Data

US 2021/0366633 A1 Nov. 25, 2021

Related U.S. Application Data

(63) Continuation of application No. PCT/JP2020/009628, filed on Mar. 6, 2020.

(30) Foreign Application Priority Data

Mar. 25, 2019 (JP) ..... JP2019-056198

(51) Int. Cl.
*H01C 10/32* (2006.01)
*H01C 1/01* (2006.01)

(52) U.S. Cl.
CPC ..... *H01C 10/32* (2013.01); *H01C 1/01* (2013.01)

(58) Field of Classification Search
CPC ..... H01C 10/32; H01C 1/01
See application file for complete search history.

(56) References Cited

U.S. PATENT DOCUMENTS 2,827,536 A * 3/1958 Moore ..... H01C 17/08 427/292
2,862,088 A * 11/1958 Mairs ..... H01C 10/00 338/202

(Continued)

FOREIGN PATENT DOCUMENTS

EP 2039742 * 3/2009 ..... C10M 169/04
JP 59-126109 7/1984

(Continued)

OTHER PUBLICATIONS

International Search Report from International Application No. PCT/JP2020/009628 dated Jun. 16, 2020.

*Primary Examiner* — Kyung S Lee
(74) *Attorney, Agent, or Firm* — Beyer Law Group LLP

(57) ABSTRACT

A variable resistor according to the present invention includes a substrate, a resistive element disposed on a first surface of the substrate, oil that coats an upper surface of the resistive element, and a slide member that slides on the upper surface of the resistive element coated with the oil, wherein an output of the variable registor changes as a position at which the slide member makes contact with the resistive element changes. The variable resistor further includes an oil repellent part that surrounds at least a part of the resistive element in plan view viewed from above the first surface of the substrate, the oil repellant part having surface free energy smaller than that of the resistive element, whereby oil can be stably held on a resistive element surface without forming irregularities on the resistive element surface.

6 Claims, 7 Drawing Sheets

(56) References Cited

U.S. PATENT DOCUMENTS

| | | | | |
|---|---|---|---|---|
| 5,554,965 | A * | 9/1996 | Sundberg | H01C 10/38 338/156 |
| 6,359,545 | B1 * | 3/2002 | Bressers | H01C 10/30 338/160 |
| 6,894,235 | B2 * | 5/2005 | Mihara | H01H 1/60 200/336 |
| 7,605,334 | B2 | 10/2009 | Naganuma et al. | |
| 9,238,784 | B2 | 1/2016 | Sato et al. | |

FOREIGN PATENT DOCUMENTS

| | | |
|---|---|---|
| JP | 5-2941 | 1/1993 |
| JP | 2001-288452 | 10/2001 |
| JP | 2006-319274 | 11/2006 |
| JP | 2007-317971 | 12/2007 |
| JP | 2012-238584 | 12/2012 |
| WO | 2006/080147 | 8/2006 |

* cited by examiner

VARIABLE RESISTOR

CLAIM OF PRIORITY

This application is a Continuation of International Application No. PCT/JP2020/009628 filed on Mar. 6, 2020, which claims benefit of Japanese Patent Application No. 2019-056198 filed on Mar. 25, 2019. The entire contents of each application noted above are hereby incorporated by reference.

BACKGROUND OF THE INVENTION

1. Field of the Invention

The present invention relates to a variable resistor whose resistance value changes when a slide member moves on a surface of a resistive element and that is, for example, used as a position detection device.

2. Description of the Related Art

A variable resistor includes a substrate on which a resistive element is provided and a slide member that moves (slides) on the resistive element while keeping contact with a surface of the resistive element. When the slide member slides on the resistive element including an electric conductor and a relative position changes, an electric resistance value of a circuit connected to the resistive element and the slide member fluctuates. This allows the variable resistor to, for example, detect a position of an external moving body that moves in association with the slide member on the basis of a voltage that changes according to the resistance value.

In a variable resistor, a lubricant such as oil is sometimes applied onto a surface of a resistive element in order to improve reliability resulting from a reduction in sliding noise (microlinearity) and resistance to wear that occurs when a sliding body slides on the surface of the resistive element. In this case, the oil needs to be held on the surface of the resistive element in order to maintain a lubricating effect. For example, Japanese Unexamined Patent Application Publication No. 2007-317971 describes a position sensor in which at least a part of a resistive element (membrane) surface has irregularities.

SUMMARY OF THE INVENTION

However, the position sensor described in Japanese Unexamined Patent Application Publication No. 2007-317971 undesirably has poor microlinearity since the irregular part of the resistive element surface causes a change in resistance value within a minute range. Furthermore, forming predetermined irregularities on the resistive element surface undesirably leads to a decrease in productivity.

The present invention provides a variable resistor that can stably hold oil on a surface of a resistive element without forming irregularities on the surface of the resistive element.

A variable resistor according to the present invention includes a substrate, a resistive element disposed on the substrate, oil that coats a surface of the resistive element, a slide member that slides on the surface of the resistive element coated with the oil, wherein an output changes as a position at which the slide member makes contact with the resistive element changes, and an oil repellent part that surrounds at least a part of the resistive element in plan view viewed from a side where the resistive element is disposed on the substrate and that has smaller surface free energy than the resistive element.

Since the resistive element is surrounded by the oil repellent part having smaller surface free energy than the resistive element, a film of oil can be held on the surface of the resistive element.

It is desirable that the oil has a weight-average molecular weight of 2000 or more and has a kinetic viscosity of 40 [$mm^2/s$] or more at 20° C. Use of the oil having this property makes it possible to suppress a change in whole resistance value of the resistive element.

It is preferable that the surface free energy of the oil repellent part is 50 [$mJ/m^2$] or less. It is preferable that the oil repellent part is formed by using resin paste using an epoxy resin as a base resin. According to these configurations, the oil repellent part has a high oil repellent property, and it is therefore possible to stably hold a film of oil having a low kinetic viscosity on the resistive element surface.

It is preferable that the oil repellent part is disposed so as to surround the resistive element along a periphery of the resistive element in plan view. It is preferable that a height from a surface of the substrate to a surface of the oil repellent part is larger than a height from the surface of the substrate to the surface of the resistive element. It is preferable that the oil repellent part has an overlapping part disposed on the surface of the resistive element. According to these configurations, it is possible to prevent a film of oil from diffusing through a gap between the resistive element and the oil repellent part, thereby stably holding the film of oil on the resistive element surface.

According to the variable resistor according to the present invention, in which an oil repellent part having small oil wettability is disposed around a resistive element, oil on a resistive element surface is prevented from flowing to a portion other than the resistive element surface. It is therefore possible to stable hold oil on the resistive element surface without forming irregularities on the resistive element surface.

DESCRIPTION OF THE PREFERRED EMBODIMENTS

Figure 1A:
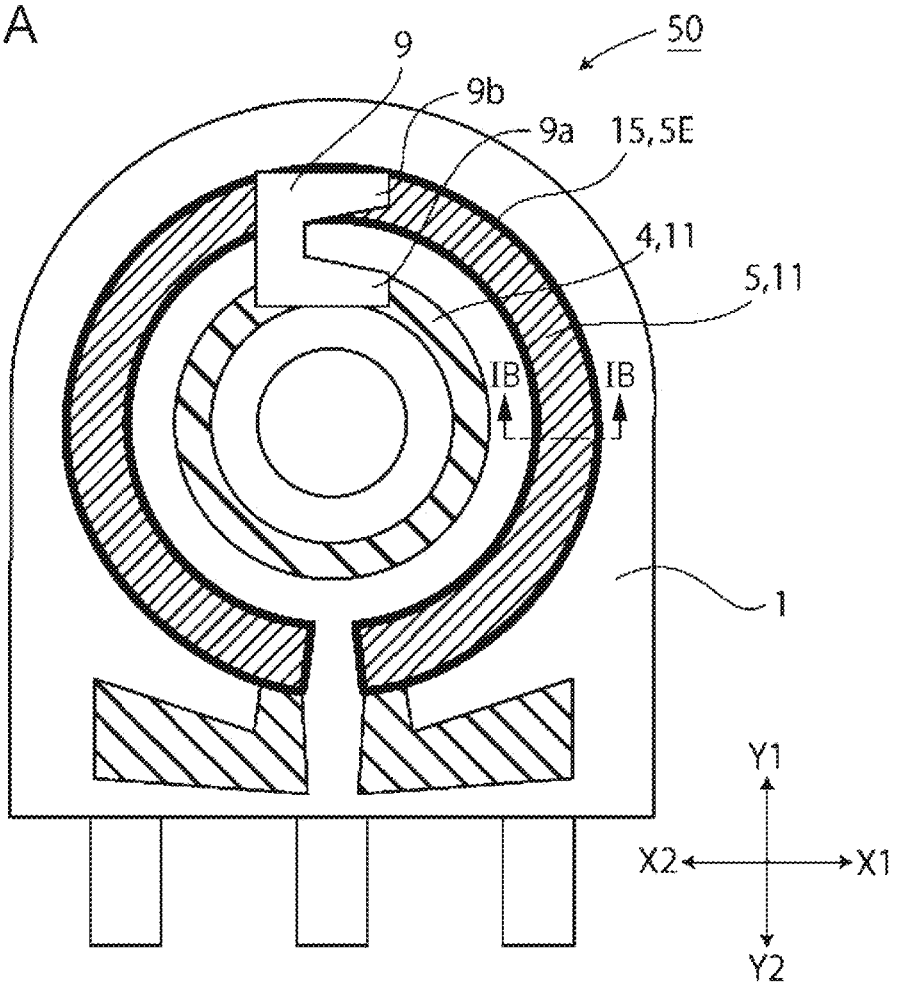
FIG. 1A is a plan view schematically illustrating a substantial part of a variable resistor according to an embodiment of the present invention.

An embodiment of the present invention is described below with reference to the drawings. In the drawings, identical members are given identical reference signs, and description thereof is omitted as appropriate.

Figure 1B:
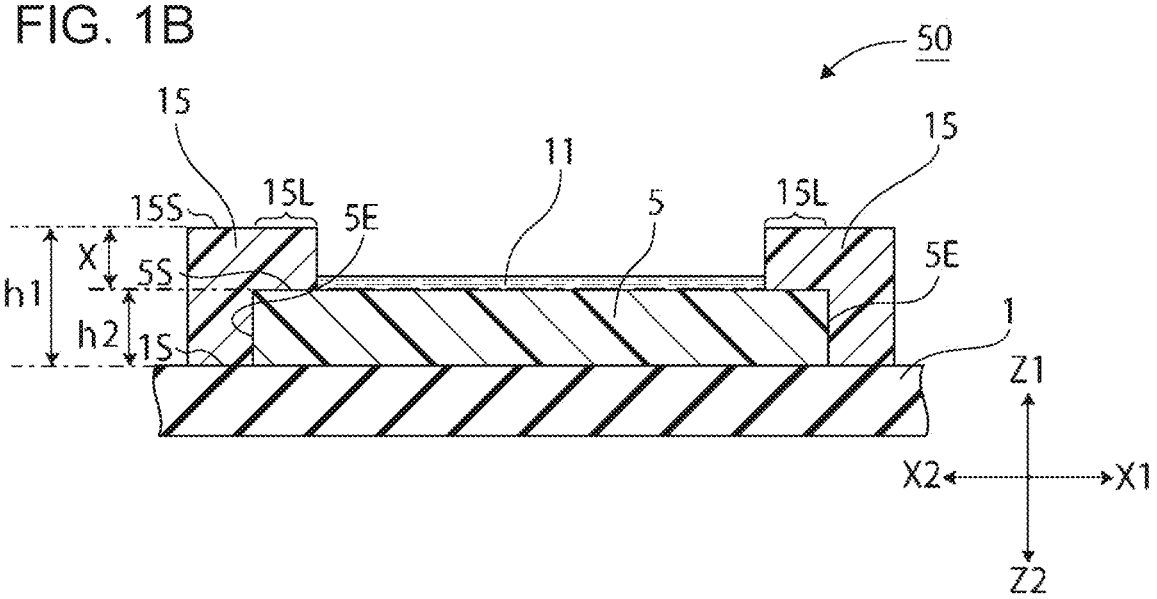
FIG. 1B is a cross-sectional view taken along line IB-IB in FIG. 1A.
Figure 2:
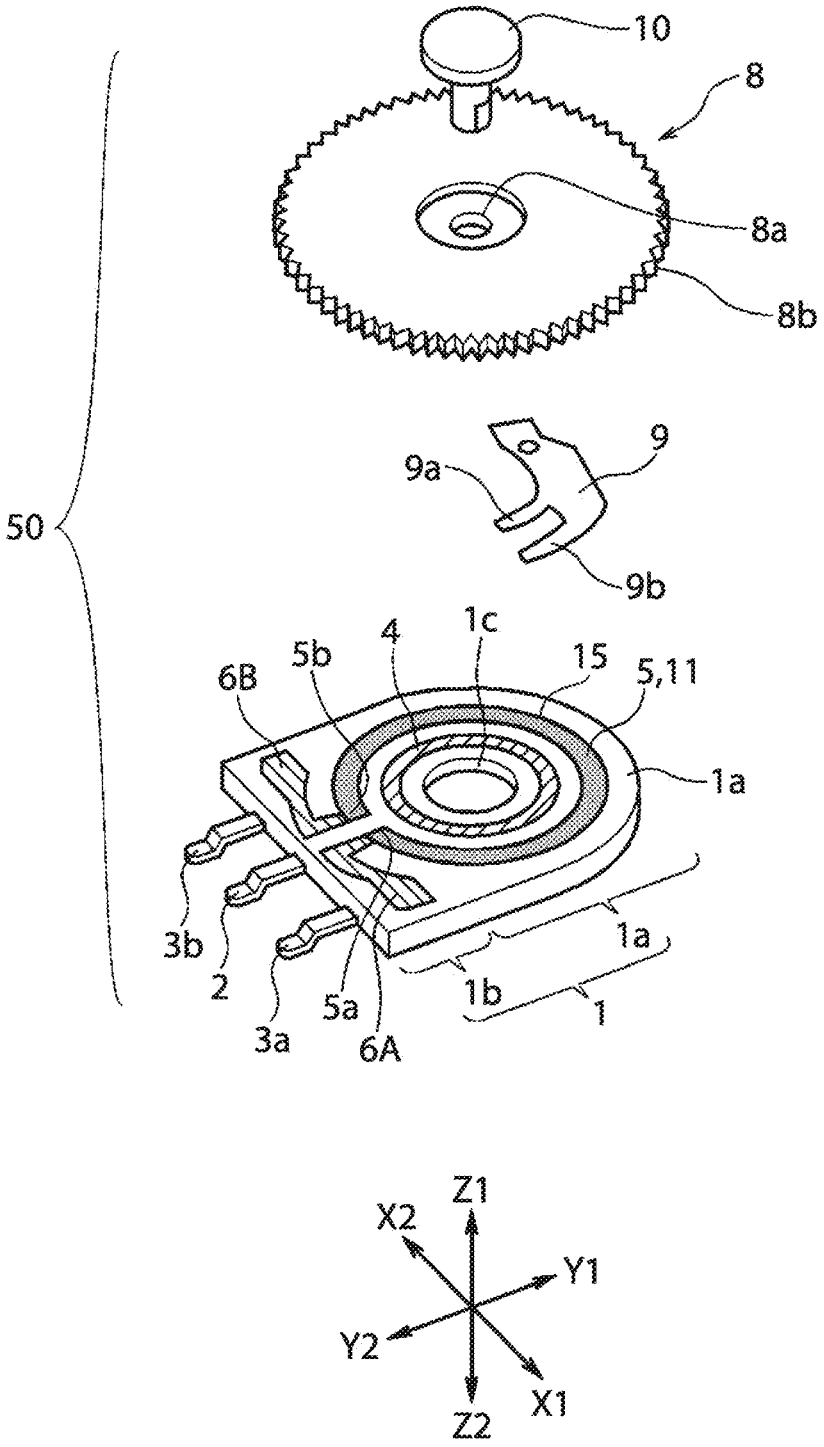
FIG. 2 is an exploded perspective view illustrating the variable resistor according to the embodiment of the present invention.

FIG. 1A is a plan view schematically illustrating a substantial part of a variable resistor according to an embodiment of the present invention, and FIG. 1B is a cross-sectional view taken along line IB-IB in FIG. 1A. FIG. 2 is an exploded perspective view illustrating the variable resistor.

A variable resistor 50 includes a substrate 1, a gripping member 8, a slide member 9, and a shaft member 10. The substrate 1 has a circular first base 1*a* and a rectangular second base 1*b* protruding from the first base 1*a*, and has a central hole 1*c* at a center of the first base 1*a*.

The substrate 1 is mainly made of an insulating molded body such as a phenolic laminated substrate, a glass-containing epoxy substrate, a molded resin substrate, or a ceramics substrate, and a resistive element 5 is provided on a surface of the substrate 1.

On a surface of the first base 1*a*, a current collecting part 4 made of an electrically conductive material containing silver or the like is provided in an annular shape around the central hole 1*c*. A terminal 2 is connected to a lower surface (a surface on a Z2 side in a Z1-Z2 axis) of the current collecting part 4, and the current collecting part 4 and the terminal 2 are set to the same potential.

The resistive element 5 having an arc shape in which a part of a circular ring is cut is provided around the current collecting part 4. Ends 5*a* and 5*b* of the resistive element 5 are electrically connected to terminals 3*a* and 3*b* through electrodes 6A and 6B, respectively, and the terminals 3*a* and 3*b* and the ends 5*a* and 5*b* of the resistive element 5 are set to the same potential, respectively.

The resistive element 5 is typically formed by using resistive element paste formed by dispersing an electric conductor such as carbon black in a binder resin dissolved in an appropriate solvent and further adding a solvent as needed. A pattern of a predetermined shape is formed by using the resistive element paste by a known screen printing method to provide the resistive element 5. The formation of the resistive element 5 may include removal of the solvent by drying and burning as needed.

As the binder resin of the resistive element paste, a phenolic resin, a polyimide resin, or the like is used to give heat resistance or the like. The resistive element paste preferably contains a filler such as a carbon fiber or silicon oxide, for example, to give wear resistance. Furthermore, the resistive element paste that forms the resistive element 5 may contain an additive such as a defoamant in addition to the above materials.

In a case where the resistive element 5 is formed in an arc shape (horseshoe shape) as illustrated in FIGS. 1A, 1B, and 2, the slide member 9 is attached rotatably relative to the substrate 1 so as to slide along the resistive element 5. This obtains a rotary-type variable resistor 50. However, a pattern of the resistive element 5 is not limited to an arc shape. For example, in a case where the resistive element 5 is formed in an elongated shape, the slide member 9 is attached slidably relative to the substrate 1 so as to slide along the resistive element 5. This obtains a slide-type variable resistor 50.

Typically, the pair of electrodes 6A and 6B are provided by, for example, screen printing electrically conductive paste such as silver on the substrate 1 before the resistive element 5 is provided. The pattern of the resistive element 5 such as an arc shape is provided so as to connect the pair of electrodes 6A and 6B, so that the electrodes 6A and 6B are provided at the ends 5A and 5B of the resistive element 5, respectively. The resistive element 5 is preferably provided so as to cover the electrodes 6A and 6B from above.

As illustrated in FIGS. 1A and 1B, surfaces of the current collecting part 4 and the resistive element 5 are coated with oil 11. The oil 11 functions as a lubricant for improving wear resistance of the surfaces of the current collecting part 4 and the resistive element 5 and can be, for example, fluorine-based oil. Examples of the fluorine-based oil include perfluoroalkylpolyether and perfluoropolyether, and both of a linear-chain type and a side-chain type can be used.

The oil 11 may contain another oil or an additive as needed, but a weight % of the fluorine-based oil in the oil 11 is preferably 80% or more, more preferably 100%.

A film thickness (a thickness in a Z1-Z2 axis direction in FIG. 1B) of the oil 11 formed as a layer on the resistive element 5 is preferably 0.07 μm or more, more preferably 0.2 μm or more, still more preferably 0.8 μm or more from the perspective of allowing the oil 11 to function as a lubricant and preventing a degradation in performance of the variable resistor 50. The film thickness is preferably 3 μm or less from the perspective of keeping stable contact between the resistive element 5 and the slide member 9.

A weight-average molecular weight of the oil 11 is preferably 2000 to 18000, more preferably 4500 to 18000. A kinetic viscosity at 20° C. is preferably 40 [$mm^2$/s] (cSt) to 500 [$mm^2$/s] (cSt), more preferably 150 [$mm^2$/s] to 500 [$mm^2$/s].

The kind of the oil 11 used as a lubricant is not limited. Examples of a commercially-available product that can be used as the oil 11 include Fomblin® series produced by Solvay Specialty Polymers, Demnum™ series produced by Daikin Industries, Ltd., Krytox™ series produced by Chemours, and "MORESCO-PHOSFAROL" (PHOSPHAROL® is a registered trademark) produced by Moresco Corporation.

As illustrated in FIGS. 1A and 1B, an oil repellent part 15 is provided so as to surround at least part of the resistive element 5 in a plan view viewed from a side where the resistive element 5 is disposed on the substrate 1 (from a Z1 side in the Z-Z2 axis in FIG. 1B). The oil repellent part 15 has smaller surface free energy (surface tension) than the resistive element 5 and is therefore hard to be wetted by the oil 11 (hereinafter referred to as "small wettability" as appropriate). Since the oil repellent part 15 that surrounds the resistive element 5 repels the oil 11, flux of the oil 11 on the surface of the resistive element 5 is suppressed, and the oil 11 can be held on the surface of the resistive element 5. Therefore, even in a case where the oil 11 has a low molecular weight and a low kinetic viscosity, the oil 11 of a predetermined film thickness can be held on the surface of the resistive element 5. Therefore, an oil having a low molecular weight and a low kinetic viscosity such as the one having a weight-average molecular weight of approximately 2000 to 5500 and a kinetic viscosity of approximately 40 [$mm^2$/s] (cSt) to 70 [$mm^2$/s] (cSt) at 20° C. can be used as the oil 11.

The wettability of the oil repellent part 15 is set smaller than wettability of the resistive element 5 from the perspective of holding the oil 11 on the surface of the resistive element 5. The surface free energy of the oil repellent part 15 is preferably 50 [mJ/$m^2$] or less, more preferably 40 [mJ/$m^2$] or less. The surface free energy is a value calculated from measurement values of contact angles of three kinds of liquid (water, bromonaphthalene, and ethylene glycol) whose surface free energy is known based on the Kitazaki-Hata theory.

The oil repellent part 15 is typically formed by using resin paste formed by adding additives such as a pigment and a defoamant to a resin dissolved in an appropriate solvent as needed. A pattern of the resin paste having a predetermined shape is formed on the surface of the resistive element 5 by a known screen printing or the like to provide the oil repellent part 15. The formation of the oil repellent part 15 may include removal of the solvent by drying and burning as needed. A resin that is contained most in the resin paste used for formation of the oil repellent part 15 is referred to as a "base resin" as appropriate.

Specific examples of the resin contained in the resin paste include thermosetting resins such as an epoxy resin, polyimide, and melamine, thermoplastic resins such as polyethylene, polypropylene, polystyrene, and polycarbonate, and photocurable resins. A resin containing a small amount of —OH is preferable and a resin containing no —OH is more preferable from the perspective of forming the oil repellent part 15 having low surface free energy. A thermosetting resin is preferable from the perspective of resistance to the oil 11.

The oil repellent part 15 is disposed along a periphery of the resistive element 5 so as to surround the resistive element 5 in plan view (when an XY plane of the substrate 1 in FIG. 1A is viewed from the Z1 side in FIG. 1B). The oil repellent part 15 makes it possible to maintain a state where the whole surface of the pattern of the resistive element 5 is covered with the layer of the oil 11.

As illustrated in FIG. 1B, the oil repellent part 15 is provided so as to be continuous with the periphery 5E of the resistive element 5. The expression "provided so as to be continuous with the periphery 5E" refers to a state where the periphery 5E of the pattern of the resistive element 5 is in contact with the oil repellent part 15 with no gap where the oil 11 flows interposed therebetween. This configuration can prevent the oil 11 from flowing out through a gap between the periphery 5E and the oil repellent part 15, thereby keeping a state where the film of the oil 11 having a predetermined film thickness is formed on the surface of the resistive element 5.

A height (a film thickness of the oil repellent part 15 in the Z1-Z2 axis direction) from a surface 1S of the substrate 1 to a surface 15S of the oil repellent part 15 is larger than a height (a film thickness of the resistive element 5 in the Z1-Z2 axis direction) from the surface 1S of the substrate 1 to a surface 5S of the resistive element 5. Therefore, the oil repellent part 15 can stably hold the oil 11 on the surface of the resistive element 5 due to a difference in height from the surface 1S of the substrate 1 in addition to a difference in surface free energy from the resistive element 5.

For example, in a case where the film thickness of the resistive element 5 is approximately 10 μm to 15 μm, the film thickness of the oil repellent part 15 in the Z1-Z2 axis direction is preferably approximately 20 μm to 50 μm. A difference between the height h1 and the height h1, that is, a height X from the surface 5S of the resistive element 5 to the surface 15S of the oil repellent part 15 is preferably 10 μm to 40 μm, more preferably 15 μm to 35 μm, still more preferably 20 μm to 30 μm.

The oil repellent part 15 has an overlapping part 15L disposed on the surface of the resistive element 5. The overlapping part 15L is a part provided on the surface of the resistive element 5 so as to overlap the resistive element 5 when the substrate 1 is viewed in plan view from the Z1 side in the Z1-Z2 axis in FIG. 1B. Thanks to the overlapping part 15L provided on the surface of the resistive element 5, the oil repellent part 15 and the resistive element 5 are formed continuously without a gap even in a case where some position deviation occurs in a screen printing process. It is therefore possible to prevent the oil 11 on the surface of the resistive element 5 from flowing out to a portion other than the surface of the resistive element 5 through a gap between the oil repellent part 15 and the resistive element 5.

As illustrated in FIG. 2, the gripping member 8 is formed in a disc shape from an insulating material and has a hole 8*a* at a center thereof. Furthermore, the gripping member 8 has a serrated part 8*b* on an outer edge thereof. The serrated part 8*b* prevents slipping between a member that gives rotation to the gripping member 8 and the outer edge.

The slide member 9 formed from a leaf spring made of a metal such as phosphor bronze is fixed to a lower part of the gripping member 8. The slide member 9 has a slider 9*a* that slides while slightly elastically pressing the surface of the current collecting part 4 and a slider 9*b* that slides while slightly elastically pressing the surface of the resistive element 5. Parts of the slider 9*a* and the slider 9*b* that make contact with the current collecting part 4 and the resistive element 5 are sliding contact points.

As the slide member 9, a noble metal material that can keep good contact with the resistive element 5 even after long-term sliding is used. Specifically, nickel silver (an alloy of copper, zinc, and nickel) having a gold-plated or silver-plated surface or an alloy of palladium, silver, platinum, nickel, or the like can be used. In particular, in a case where there is a concern about surface oxidation at a high temperature, it is desirable to use a noble metal alloy in order to keep a stable contact state.

The shaft member 10 passes through the hole 8*a* of the gripping member 8 and the central hole 1*c* of the substrate 1, and a front end of the shaft member 10 is held on a rear surface side of the substrate 1 so that the shaft member 10 does not come out of the central hole 1*c* of the substrate 1. The gripping member 8 is rotatable together with the slide member 9 while facing the substrate 1.

When rotation is given to the gripping member 8, the sliders 9*a* and 9*b* of the slide member 9 slide on the surfaces of the current collecting part 4 and the resistive element 5, respectively, and therefore a resistance value between the terminal 2 and the terminals 3*a* and 3*b* changes. Since a position of an external moving body that moves in association with rotation of the gripping member 8 can be detected based on the resistance value, the variable resistor 50 can be used as a position detection device. Note that a constant voltage may be applied between the terminal 3*a* and the terminal 3*b* and a position may be detected from a change in output voltage while using a potential at a position of contact of the slider 9*b* as an output.

Figure 3A:
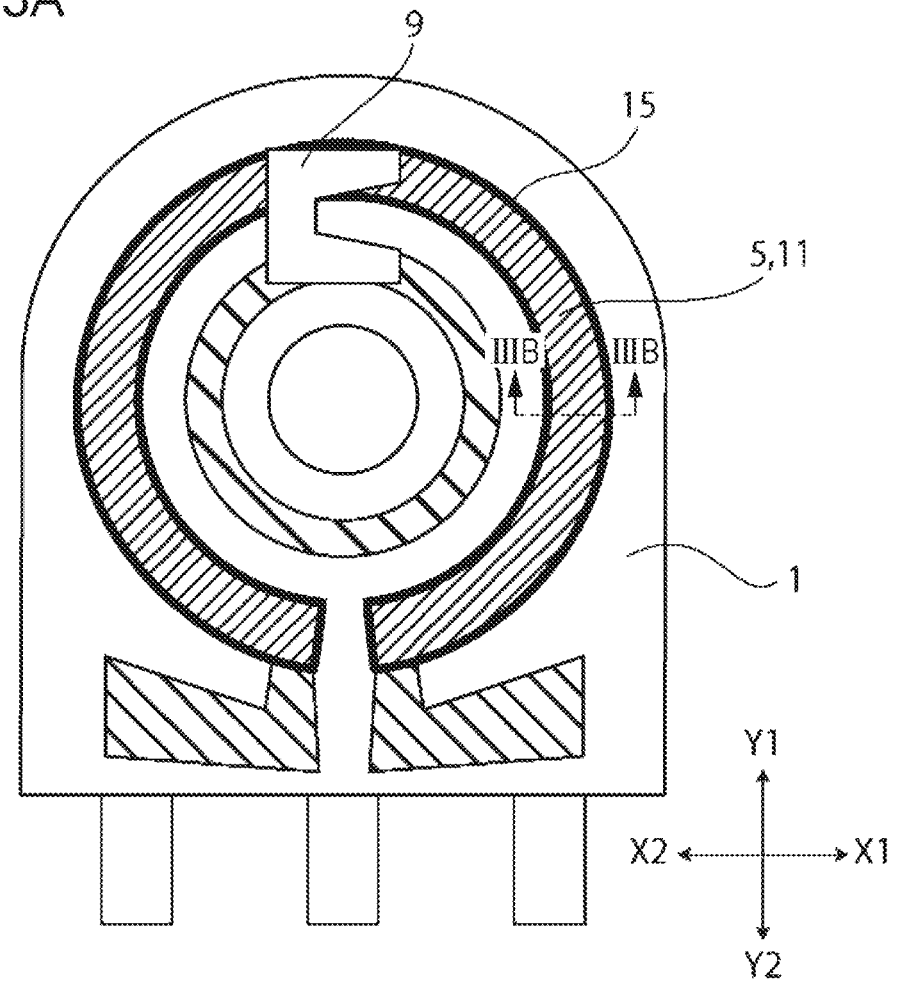
FIG. 3A is a plan view schematically illustrating a modification of the substantial part of the variable resistor according to the embodiment of the present invention.
Figure 3B:
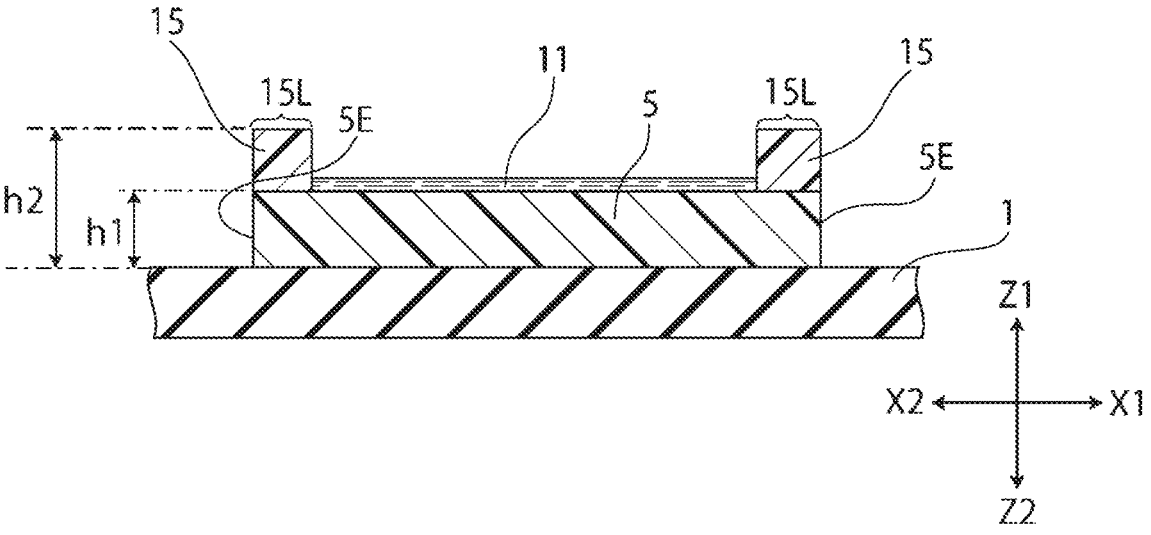
FIG. 3B is a cross-sectional view taken along line IIIB-IIIB in FIG. 3A.

FIG. 3A is a plan view schematically illustrating a modification of the substantial part of the variable resistor according to the embodiment of the present invention, and FIG. 3B is a cross-sectional view taken along line IIIB-IIIB in FIG. 3A. As illustrated in FIGS. 3A and 3B, the oil repellent part 15 may be constituted only by the overlapping part 15L disposed on the surface of the resistive element 5.

Figure 4A:
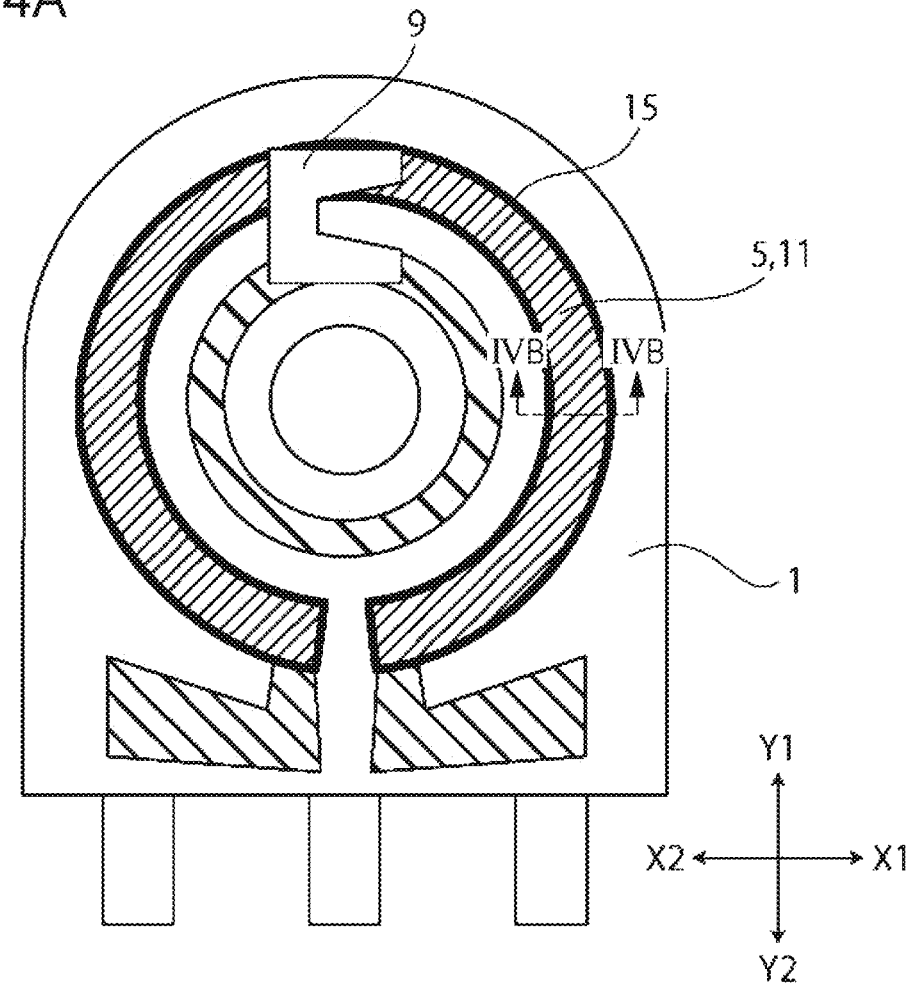
FIG. 4A is a plan view schematically illustrating another modification of the substantial part of the variable resistor according to the embodiment of the present invention.
Figure 4B:
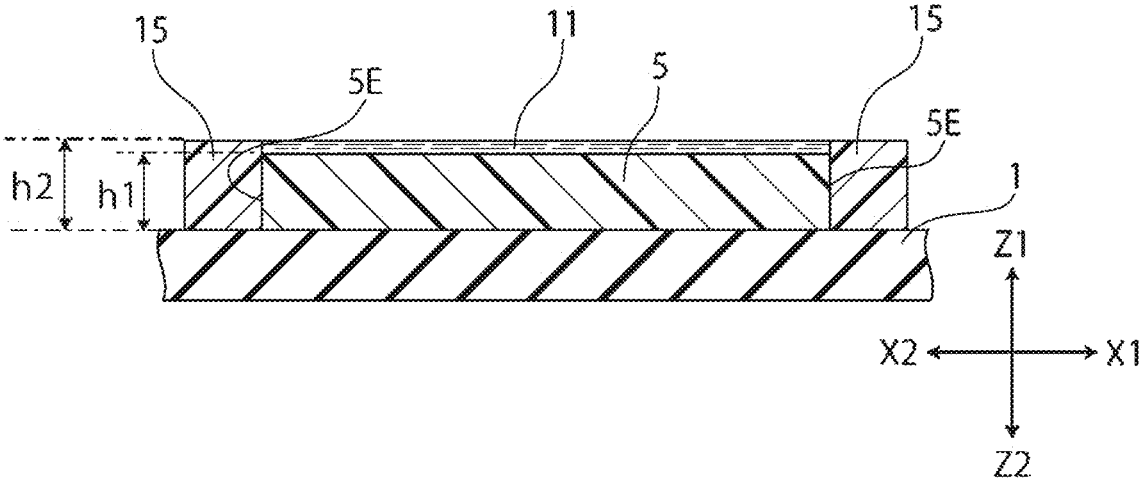
FIG. 4B is a cross-sectional view taken along line IVB-IVB in FIG. 4A.

FIG. 4A is a plan view schematically illustrating another modification of the substantial part of the variable resistor according to the embodiment of the present invention, and FIG. 4B is a cross-sectional view taken along line IVB-IVB in FIG. 4A. As illustrated in FIGS. 4A and 4B, the oil repellent part 15 may be configured not to include the overlapping part 15L disposed on the surface of the resistive element 5. In this case, the height h2 from the substrate surface to the surface of the oil repellent part 15 is set larger than a sum of the height h1 from the substrate surface to the resistive element surface and the film thickness of the oil 11 (h2>h1+oil film thickness).

EXAMPLES

The present invention is further specifically described by using Example and others, but the scope of the present invention is not limited to Example and others.

Example 1

Oil was applied onto a resistive element provided with an oil repellent part so that an initial oil film thickness became 1.2 μm, and an oil film thickness on a resistive element surface was measured after a high-temperature storage test (after 86 hours).

The resistive element was formed on a substrate by using resin paste (carbon black/graphite was used as an electric conductor, and a phenolic resin was used as a binder resin). The height h2 (see FIG. 1B) from a substrate surface to the resistive element surface was set to 12 μm to 13 μm. Surface free energy of the resistive element was 54.6 [mJ/m$^2$].

The oil repellent part was formed by using resin paste containing approximately 60% epoxy resin by weight as a base resin. The oil repellent part was formed so as to surround the resistive element so that the height h1 from the substrate surface to the oil repellent part surface became 36 μm to 38 μm and a difference X between h1 and the height h of the resistive element became 23 μm to 26 μm (see FIGS. 1A and 1B). Surface free energy of the oil repellent part was 39.9 [mJ/m$^2$].

Comparative Examples 1 to 3

A resistive element identical to the resistive element of Example 1 except for that no oil repellent part was provided was formed. Oil identical to the oil of Example 1 was applied to a resistive element surface so that a film thickness of the oil became 0.7 μm, 1.2 μm, and 1.6 μm (Comparative Examples 1, 2, and 3), and a film thickness of the oil on the resistive element surface was measured after a high-temperature storage test (after 86 hours).

Test Method

As a storage test under a high-temperature condition assuming long-term storage, the film thickness of the oil on the surface of the resistive element was measured after 86-hour storage at 128° C. In addition, a state of the resistive element surface after the test was visually checked. During the storage at the high temperature, the variable resistor was placed so that the XY plane (see FIG. 1A) of the substrate 1 became vertical.

Figure 5:
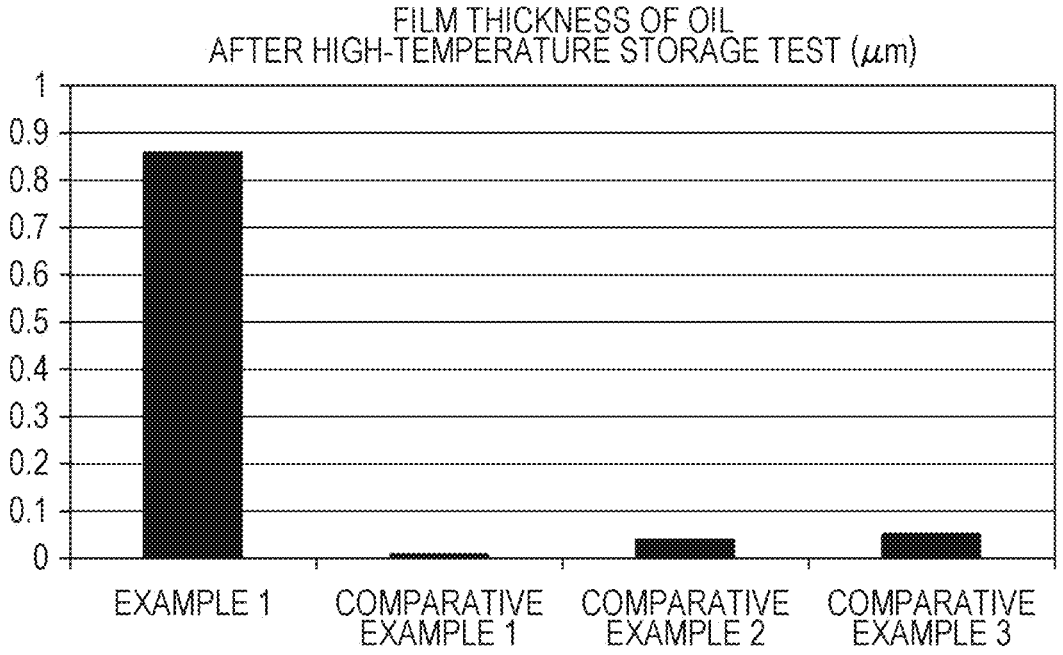
FIG. 5 is a graph illustrating measurement results of Example 1 and Comparative Examples 1 to 3.

Table 1 and FIG. 5 illustrate measurement results of Example 1 and Comparative Examples 1 to 3.

TABLE 1

| | film thickness of oil (μm) | | surface state (visually checked) |
|---|---|---|---|
| | initial | after high-temperature storage test | after high-temperature storage test |
| Example 1 | 1.2 | 0.86 | dark color |
| Comparative Example 1 | 0.7 | 0.01 | light color |
| Comparative Example 2 | 1.2 | 0.04 | light color |

TABLE 1-continued

| | film thickness of oil (μm) | | surface state (visually checked) |
|---|---|---|---|
| | initial | after high-temperature storage test | after high-temperature storage test |
| Comparative Example 3 | 1.6 | 0.05 | light color |

In the variable resistor of Example 1, the surface of the resistive element onto which the oil was applied still had a dark color and a wet state even after the high-temperature storage test. Furthermore, the oil on the surface of the resistive element still had a film thickness enough to produce a lubricating function. This result shows that the film thickness of the oil formed on the surface of the resistive element can be kept for a long term under a high-temperature condition in a case where the oil repellent part is provided so as to surround the resistive element pattern. Meanwhile, in all of the variable resistors of Comparative Examples 1 to 3, the surface of the resistive element onto which the oil was applied had a light color and failed to keep a wet state. Furthermore, the film thickness of the oil on the surface of the resistive element was not enough to produce a lubricating function.

Figure 6:
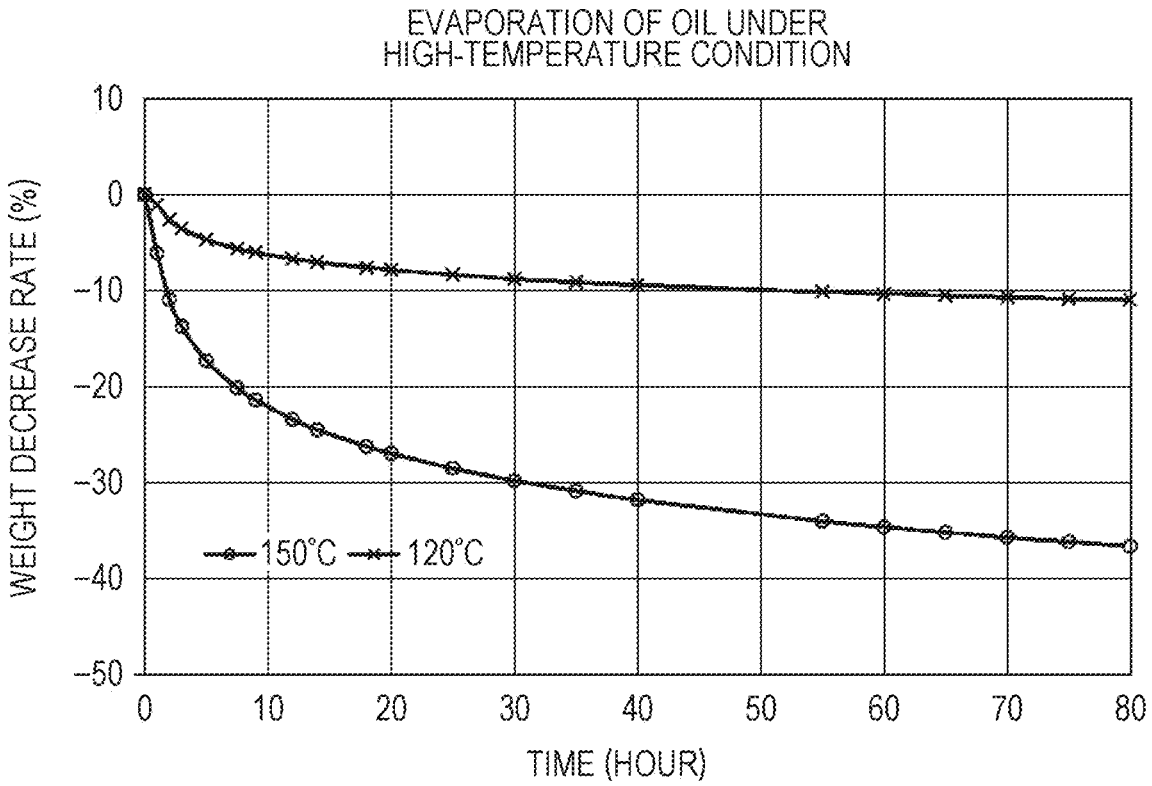
FIG. 6 is a graph illustrating weight losses of oil caused by heat by TG-DTA.

From the graph of weight losses under 120° C. and 150° C. conditions illustrated in FIG. 6, it is estimated that oil that evaporates after a 86-hour high-temperature storage test under a 128° C. condition is approximately 10% to 20%. Meanwhile, in Comparative Examples 1 to 3, 90% or more of the oil on the resistive element surface was lost after the high-temperature storage test. These show that a reason why the oil on the resistive element surface was lost is not evaporation of the oil, but movement of the oil to a place different from the surface of the resistive element due to an increase in flux of the oil.

It can be said that the variable resistor of Example 1 could keep a film of oil on the resistive element surface since the oil repellent part surrounding the resistive element suppressed flux of the oil.

Comparative Example 4

A storage test under a high-temperature condition was conducted in a manner similar to Example 1 except for that the resin paste used to form the oil repellent part was changed as described below.

Resin paste containing approximately 50% xylene resin by weight as a base resin was used instead of the resin paste of Example 1. Surface free energy of the oil repellent part was 136.9 [mJ/m$^2$].

Comparative Example 5

A storage test under a high-temperature condition was conducted in a manner similar to Example 1 except for that the resin paste used to form the oil repellent part was changed as described below.

Resin paste containing approximately 40% phenolic resin by weight as a base resin was used instead of the resin paste of Example 1. Surface free energy of the oil repellent part was 159.8 [mJ/m$^2$].

Figure 7:
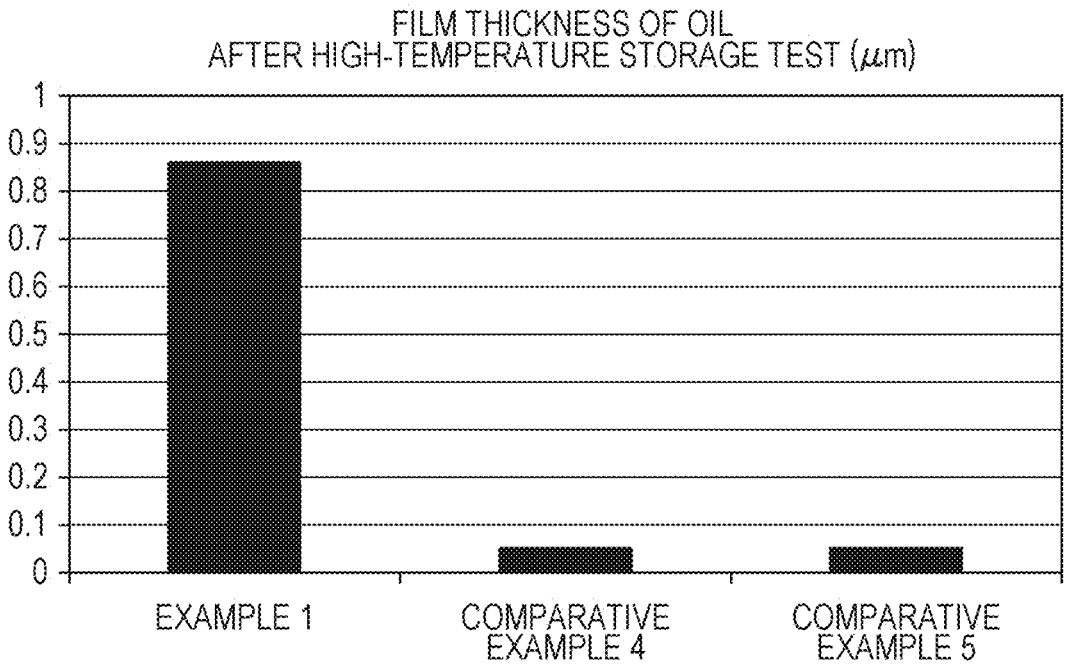
FIG. 7 is a graph illustrating measurement results of Example 1 and Comparative Examples 4 and 5.

Table 2 and FIG. 7 show measurement results of Example 1 and Comparative Examples 4 and 5.

TABLE 2

| | film thickness of oil (μm) | | surface state (visually checked) |
|---|---|---|---|
| | initial | after high-temperature storage test | after high-temperature storage test |
| Example 1 | 1.2 | 0.86 | dark color |
| Comparative Example 4 | 1.2 | 0.05 | light color |
| Comparative Example 5 | 1.2 | 0.05 | light color |

In a case where the oil repellent part was formed by using resin paste using phenol or xylene as a base resin, a sufficient film thickness of the oil on the surface of the resistive element could not be kept after the high-temperature storage test. This is considered to be because the oil repellent parts of Comparative Examples 4 and 5 have larger surface free energy than the resistive element and have good oil wettability and therefore could not prevent the oil on the resistive element surface from flowing to a portion other than the resistive element surface.

Meanwhile, the oil repellent part of Example 1 formed by using resin paste using epoxy as a base resin have smaller surface free energy than the resistive element. It can therefore be said that the oil on the resistive element surface could be prevented from flowing to a different portion due to an oil repelling effect of the oil repellent part that has poor oil wettability.

These results show that an oil repellent part provided so as to surround a resistive element needs to have smaller surface free energy than the resistive element and have poor oil wettability to function as a barrier preventing the oil on the resistive element surface from flowing to a different portion. It is therefore preferable to use a resin having an oil repelling property as a base resin of resin paste used to form an oil repellent part.

The present invention is a variable resistor having high reliability under a high-temperature condition and can be used, for example, as a position detection device or the like.

What is claimed is:

1. A variable resistor comprising:

a substrate;

a resistive element disposed on a first surface of the substrate, oil that coats an upper surface of the resistive element; and a slide member that slides on the upper surface of the resistive element coated with the oil, wherein an output of the variable resistor changes as a position at which the slide member makes contact with the resistive element changes, and whererin the variable resistor further comprises:

an oil repellent part that surrounds at least a part of the resistive element in plan view viewed from above the first surface of the substrate, the oil repellant part having surface free energy smaller than that of the resistive element, and the oil repellent part including an overlapping portion disposed over the upper surface of the resistive element.

2. The variable resistor according to claim 1, wherein the oil has a weight-average molecular weight equal to or greater than 2000, and a kinetic viscosity equal to or greater than of 40 $mm^2/s$ at 20° C.

3. The variable resistor according to claim 1, wherein the surface free energy of the oil repellent part is equal to or smaller than 50 $mJ/m^2$ .

4. The variable resistor according to claim 1, wherein the oil repellent part is formed from a resin paste including an epoxy resin as a base resin.

5. The variable resistor according to claim 1, wherein the oil repellent part surrounds the resistive element along a periphery of the resistive element in the plan view.

6. The variable resistor according to claim 1, wherein a distance from the first surface of the substrate to an upper surface of the oil repellent part is greater than a distance from the first surface of the substrate to the upper surface of the resistive element.

* * * * *